US006595439B1

(12) United States Patent
Chen

(10) Patent No.: US 6,595,439 B1
(45) Date of Patent: Jul. 22, 2003

(54) LONG-HANDLED SPRAY GUN WITH A ROTARY HEAD

(76) Inventor: Ming Jen Chen, No. 39, Mo Dan Lane, Chao An Li, Lu Kang Chen, Changhua Hsien (TW)

( * ) Notice: Subject to any disclaimer, the term of this patent is extended or adjusted under 35 U.S.C. 154(b) by 0 days.

(21) Appl. No.: 10/261,766

(22) Filed: Oct. 2, 2002

(30) Foreign Application Priority Data

May 3, 2002 (CN) ..... 091292497 A

(51) Int. Cl.[7] ..... B05B 3/00
(52) U.S. Cl. ..... 239/225.1; 239/280; 239/530
(58) Field of Search ..... 239/280, 530, 239/225.1, 251–253, 263, 525, 526, 280.5, 281, 532, 587.1, 587.3, 587.4

(56) References Cited

U.S. PATENT DOCUMENTS 2,884,206 A * 4/1959 Dukes ..... 239/530
3,908,910 A * 9/1975 Detwiler ..... 239/280
6,322,006 B1 * 11/2001 Guo ..... 239/532

* cited by examiner

*Primary Examiner*—Lisa A. Douglas
(74) *Attorney, Agent, or Firm*—Troxell Law Office PLLC

(57) ABSTRACT

A long-handled spray gun with a rotary head has a connector head, a rotary member, a fixed member, a connection, part, a long tubular rod, a block, a fixing bolt, a large and a small ring washers and a flexible locating member wherein the rotary member screw joined to the connector head at one side is pivotally engaged with the fixed member with the large and small ring washers adapted therein and the flexible locating member inserted into one of locating slots of the rotary member for proper location thereof, and the connection part is coupled with the fixed member and the long tubular rod at both ends respectively. The fixing bolt is adapted to pivotally engage the rotary member with the fixed member thereof and the block having a serrated polygonal flange disposed thereon is matched to a serrated polygonal fixing head of the fixed member, preventing the fixing bolt from coming off when the rotary member thereof are pivotally rotated. Via the rotary member, the connector head can be easily and quickly adjusted stepwise into a proper angle for use.

6 Claims, 4 Drawing Sheets

LONG-HANDLED SPRAY GUN WITH A ROTARY HEAD

BACKGROUND OF THE INVENTION

The present invention is related to a long-handled spray gun with a rotary head, comprising a connector head, a rotary member, a fixed member, a connection part and a long tubular rod wherein said rotary member screw joined to said connector head at one end is pivotally engaged with one side of said fixed member, and said connection part is coupled with said fixed member and said long tubular rod at both end thereof respectively. Via said rotary member, said connector head can be easily and quickly adjusted into a proper angle for use.

Please refer to FIG. 1. A conventional long-handled spray gun 10 is mainly made up of a spray head 11, a connection part 12, and a long tubular rod 13 wherein said spray head 11 having an internally threaded end 111 is screw joined to an externally threaded front end 121 of said connection part 12 thereof and communicated therewith via a water discharge hole 122 disposed at the center of said externally threaded front end 121 thereof. Said connection part 12 bent in an angle also has a coupling end 123 with a water inlet hole 124 disposed at the center thereof to be sleeve joined to said long tubular rod 13 thereof at the other end thereof. Said long tubular rod 13 having a tubular body 131 of proper length can also be attached to a control handle at the lower section thereof to complete the assembly for use.

There are some drawbacks to such conventional long-handled spray gun. Most of all, said spray head 11 is fixedly attached to said long tubular rod 13 via said connection part 12 at a certain angle which makes it hard to adjust the direction of said spray head 11 for use. Sometimes, hands or body is required to move so as to adjust said spray head 11 into a desirable angle in use, which is quite troublesome and inconvenient.

SUMMARY OF THE PRESENT INVENTION

It is, therefore, the primary purpose of the present invention to provide a long-handled spray gun with a rotary head, comprising a connector head, a rotary member, a fixed member, a connection part and a long tubular rod wherein said connector head is screw joined to one side of said rotary member, and said long tubular rod is connected with said fixed member via said connection part thereof. A staged groove and a tubular column disposed at one inner side of said rotary member thereof are engaged with a fixing post and a circular outer flange disposed at one side of said fixed member. A block is applied to said fixing post and further secured thereto via a fixing bolt so as to pivotally engage said rotary member and said fixed member thereof. Via said rotary member, said connector head can be easily and quickly adjusted into a proper angle for use thereof.

It is, therefore, the second purpose of the present invention to provide a long-handled spray gun with a rotary head wherein said block thereof having serrated polygonal flanges disposed at one inner side thereof is securely matched to a serrated polygonal head projecting at the front of said fixing post thereof and further secured thereto via said fixing bolt screwed up to internal threads disposed at the interior of said fixing post thereof. Said rotary member and said fixed member are securely engaged, preventing said fixing bolt from coming off when said rotary member are pivotally rotated thereof.

BRIEF DECRIPTION OF THE DRAWINGS

DETAILED DESCRIPTION OF THE PREFERRED EMBODIMENTS

Figure 1:
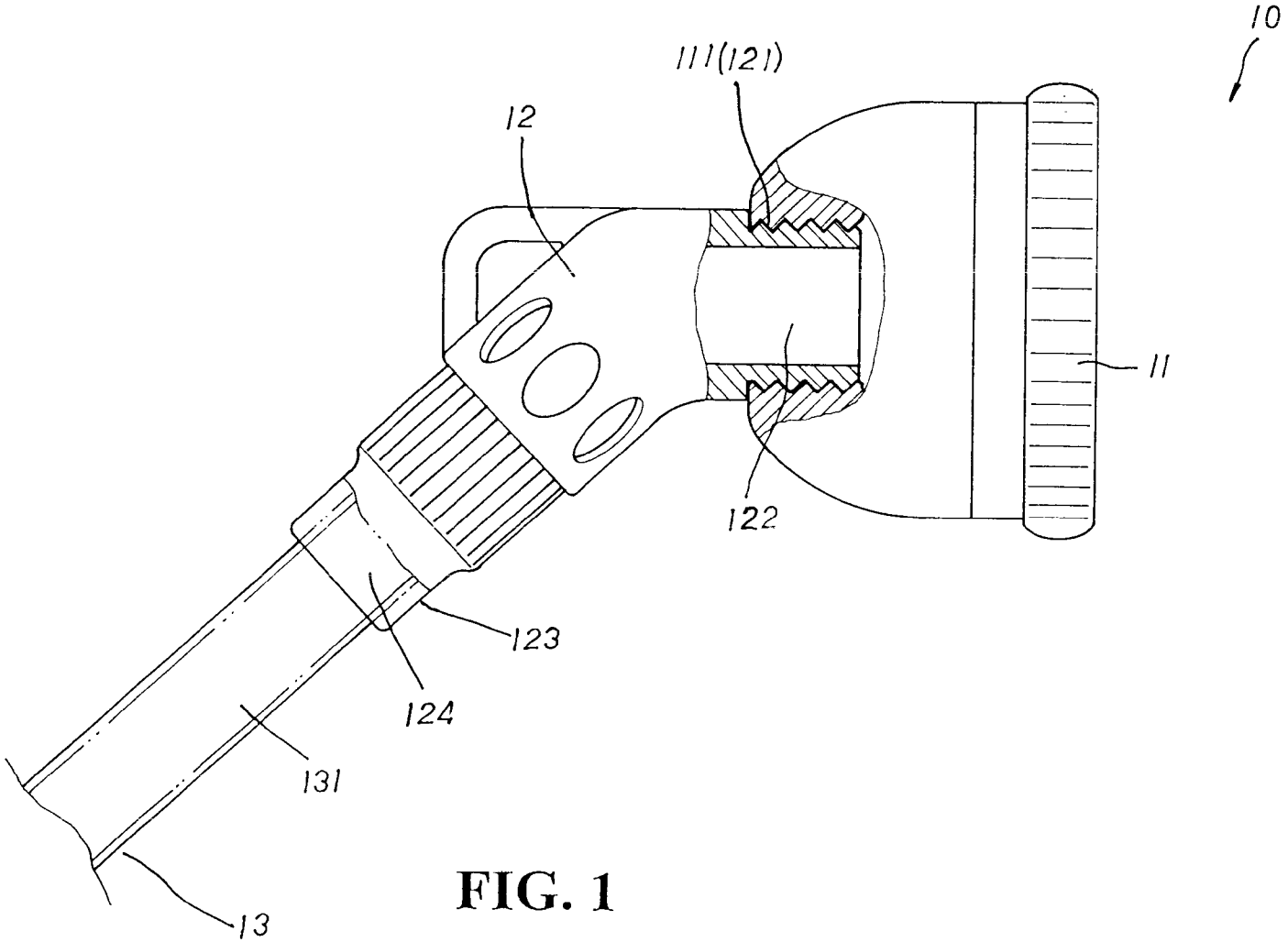
FIG. 1 PRIOR ART
FIG. 1 is a sectional view of a conventional long-handled spray gun in assembly.
Figure 2:
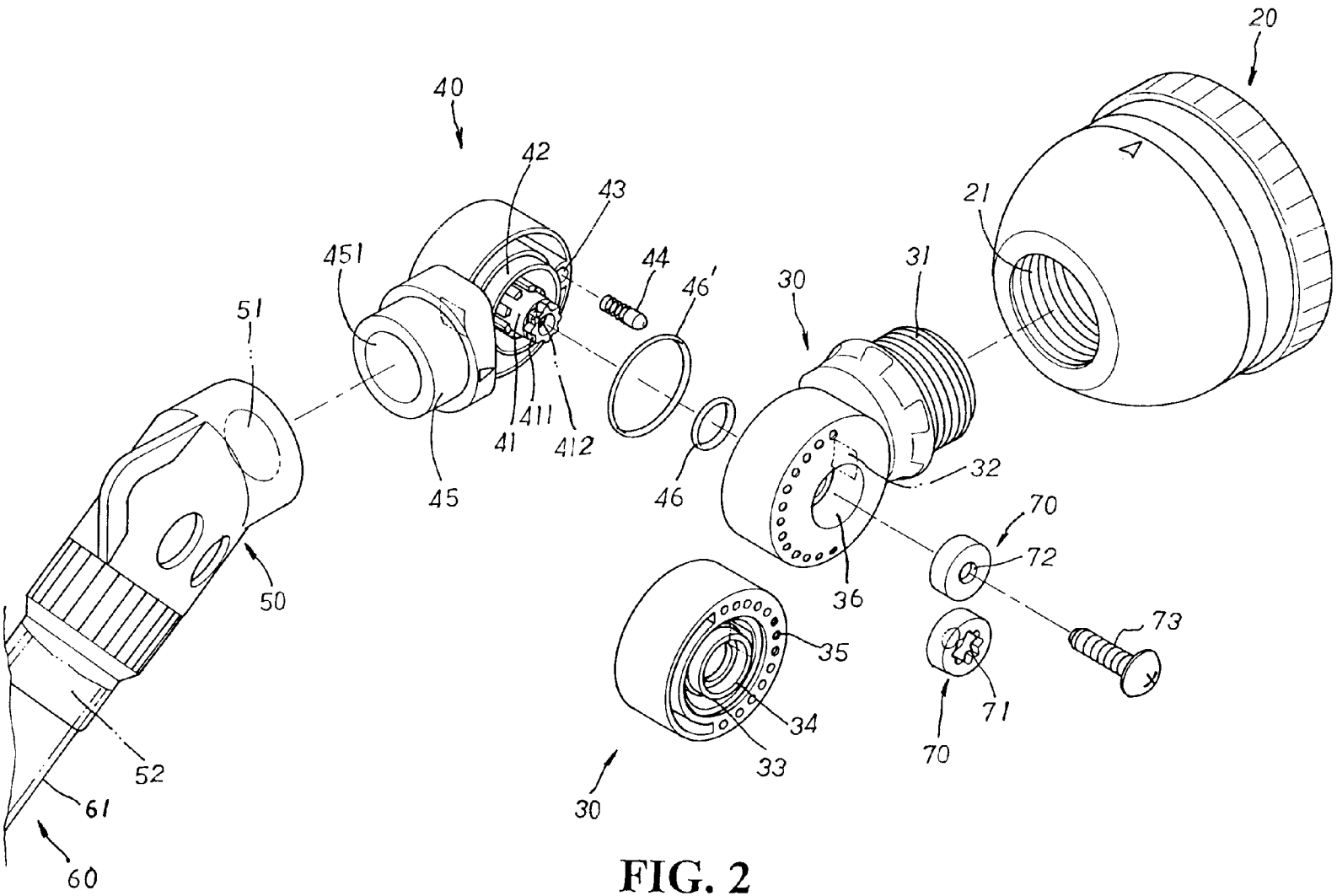
FIG. 2 is a perspective exploded view of the present invention.

Please refer to FIG. 1. The present invention is related to a long-handled spray gun with a rotary head, comprising a connector head 20, a rotary member 30, a fixed member 40, a connection part 50, a long tubular rod 60, a block 70, a fixing bolt 73, a small and a large ring washers 46, 46' and a flexible locating means 44.

Said connector head 20 is provided with internal threads 21 disposed at one end thereof. Said rotary member 30 is equipped with an externally threaded tubular front end 31, a water outlet port 32 disposed at the center of the rear end thereof, a staged groove 33 disposed transversely at one side of said rear end thereof in communication with said externally threaded tubular front end 31 thereof via said water outlet port 32 thereof, and a tubular column 34 projecting at the inner side of said staged groove 33 thereof. A multiple of locating slots 35 are distributed in a semi-circle at the upper side of said staged groove 33 thereof, and a staged through hole 36 is disposed at the center of said tubular column 34 thereof. Said fixed member 40 is mainly made up of a fixing post 41 disposed transversely at one side of the front end thereof for said small ring washer 46 to be adapted thereto, and a circular outer flange 42 circumscribing said fixing post 41 thereof for said large ring washer 46' to be adapted thereto. Said fixing post 41 has a serrated polygonal head 411 projecting at the front end thereof and internal threads 412 disposed at the interior thereof. Said fixed member 40 also includes a fixing cavity 43 disposed at one upper side of said circular outer flange 42 thereof for said flexible locating means 44 to be adapted thereto at one end, a fixing joint 45 disposed at the rear end thereof, and a water inlet hole 451 disposed at the center of said fixing joint 45 thereof in communication with the space defined by said circular outer flange 42 and said fixing post 41 thereof.

Figure 3:
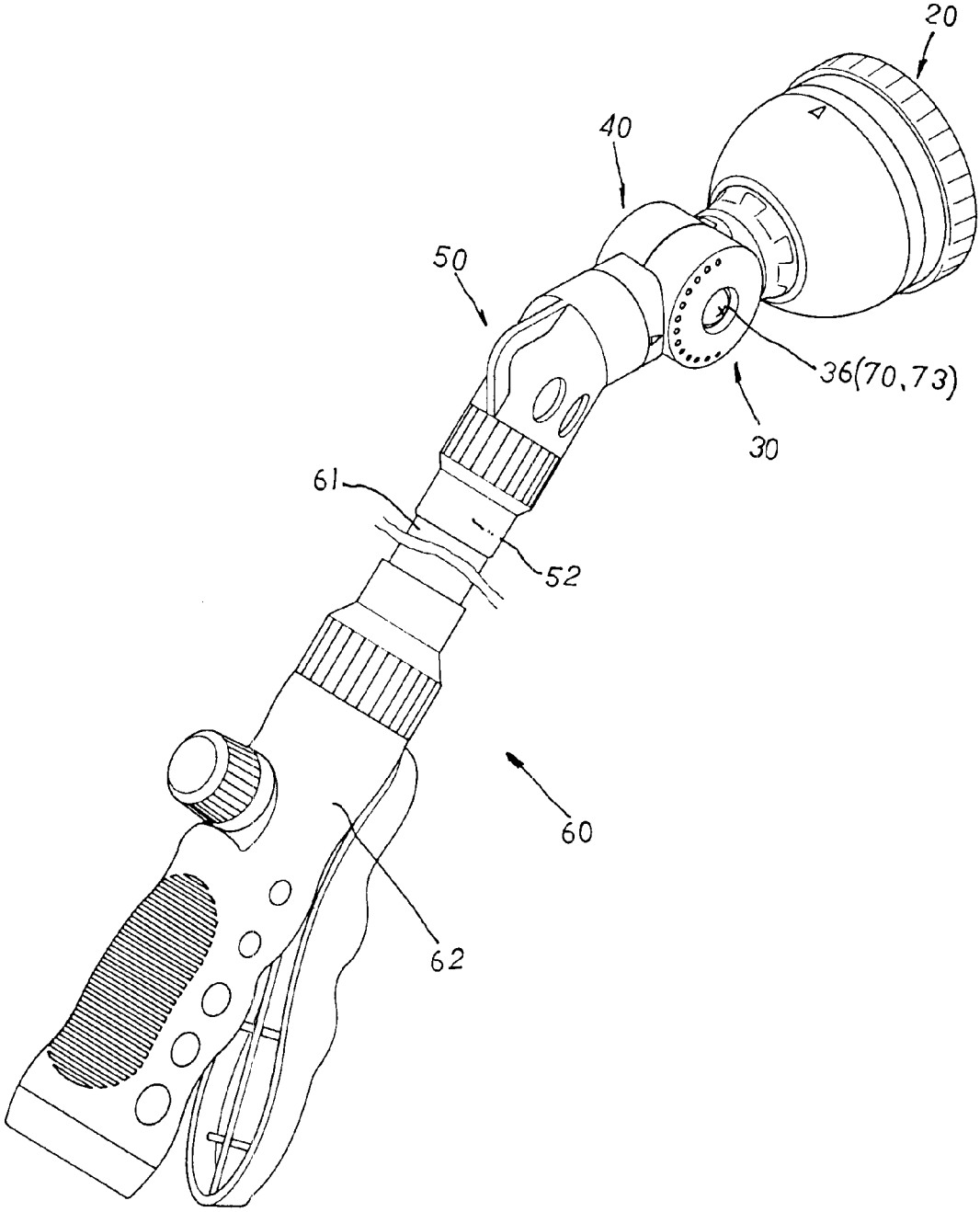
FIG. 3 is a perspective view of the present invention in assembly.

Said connection part 50, bent in an angle, is provided with an upper and a lower coupling holes 51, 52 disposed at both ends thereof. Said long tubular rod 60 is a tube body 61 of proper length with a control handle 62 disposed at the lower section thereof as shown in FIG. 3. Said block 70 has serrated polygonal flange 71 disposed at one inner side thereof, and a slot 72 disposed at the center thereof.

Please refer to FIG. 3. In assembly, said staged groove 33 and said tubular column 34 thereof are led and joined to said circular outer flange 42 and said fixing post 41 thereof with said large and small ring washers 46', 46 adapted thereto respectively. Said flexible locating means 44 adapted to said fixing cavity 43 thereof at one end is inserted to one of said locating slots 35 thereof at the other end for proper location thereof. Said serrated polygonal head 411 of said fixed member 40 thereof is led through said staged through hole 36 of said rotary member 30 thereof and abutted thereto. Said block 70 is then led through said fixing post 41 via said slot 71 thereof and joined thereto via said serrated polygonal flange 71 thereof securely engaging with said serrated polygonal head 411 thereof. Said fixing bolt 73 is adapted and screwed up to said internal threads 412 of said fixing post 41 thereof so as to pivotally secure said rotary member 30 and said fixed member 40 thereof. The externally threaded tubular front end 31 of said rotary member 30 is applied with fastening agents and screwed up to the internal threads 21 of said connector head 20 for secure engagement thereof. The fixing joint 45 of said fixed member 40 can be inserted to the upper coupling hole 51 of said connection part 50 and securely joined thereto, and said long tubular rod 60 can be securely engaged with the lower coupling hole 52 thereof to complete the assembly.

Figure 4:
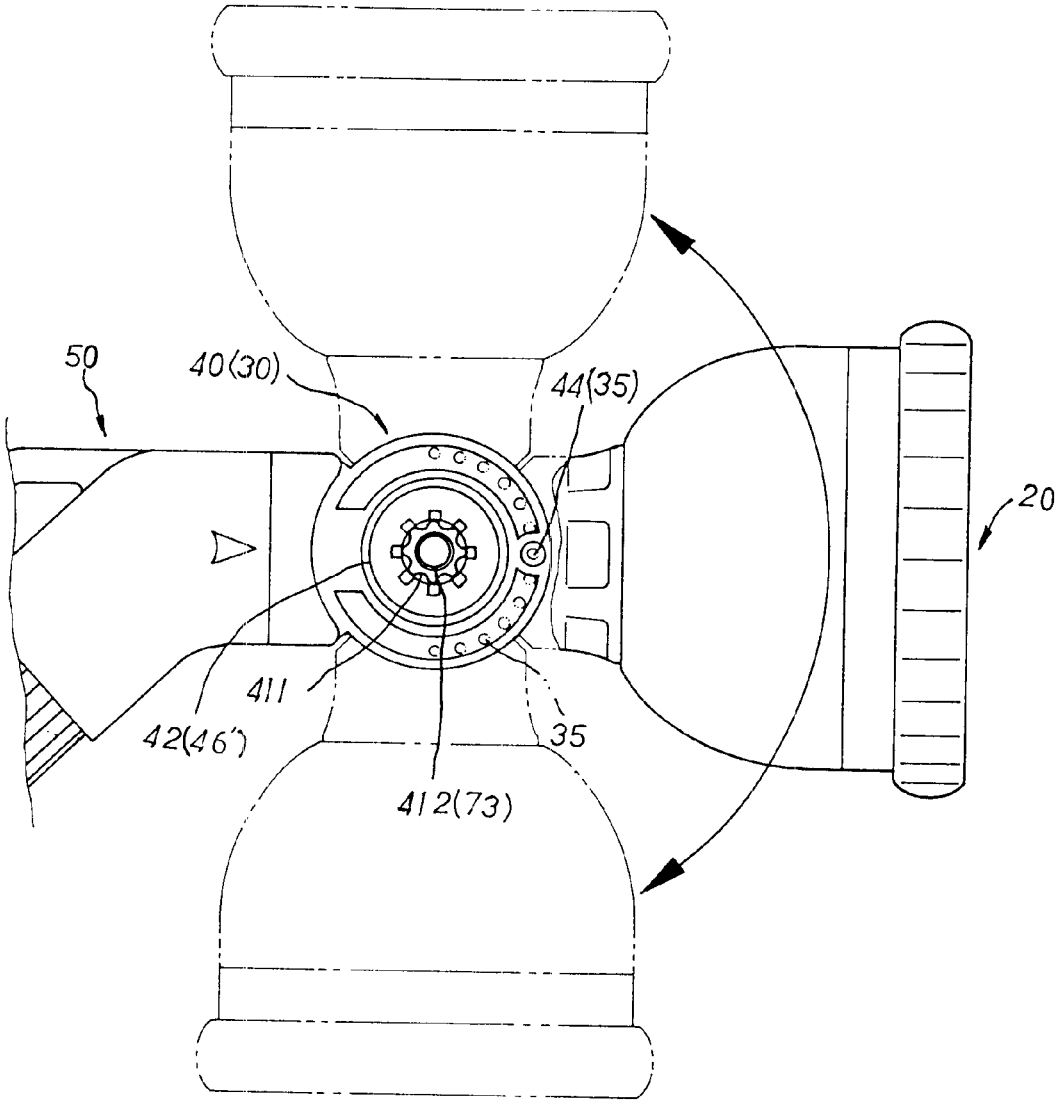
FIG. 4 is a section view of the present invention in operation.

Please refer to FIG. 4. Via said rotary member 30, said connector head 20 can be adjusted stepwise into a proper angle for use. When said connector head 20 is pushed up or down in a direction as shown by the arrow in FIG. 4, said rotary member 30 screw joined to said connector head 20 thereof will pivotally rotate therewith and then relocated into position via said flexible locating means 44 properly engaged with one of said locating slots 35 thereof so as to easily and quickly adjust said connector head 20 thereof into a proper angle for use.

What is claimed is:

1. A long-handled spray gun with a rotary head, comprising a connector head, a rotary member, a fixed member, a connection part, a long tubular rod, a block, a fixing bolt, a small and a large ring washers and a flexible locating means wherein said connector head having internal threads disposed at one end is screw joined to said rotary member, and said connection part is securely engaged with said fixed member and said long tubular rod respectively at both ends thereof; said long-handle spray gun with a rotary head of the present invention being characterized by that, said rotary member having an externally threaded tubular front end, a water outlet port disposed at the center of the rear end thereof, a staged groove disposed transversely at one side of said rear end thereof in communication with said externally threaded tubular front end thereof via said water outlet port thereof, and a tubular column disposed at the inner side of said staged groove thereof; a multiple of locating slots being distributed in a semi-circle at the upper side of said staged groove thereof, and a staged through hole being disposed at the center of said tubular column thereof;

said fixed member being equipped with a fixing post disposed transversely at one side of the front end thereof for said small ring washer to be adapted thereto, and a circular outer flange circumscribing said fixing post thereof for said large ring washer to be adapted thereto; said fixing post having a serrated polygonal head projecting at the front end thereof and internal threads disposed at the interior thereof; said fixed member also including a fixing cavity disposed at one upper side of said circular outer flange thereof for said flexible locating means to be adapted thereto at one end, a fixing joint disposed at the rear end thereof, and a water inlet hole disposed at the center of said fixing joint thereof in communication with the space defined by said circular outer flange and said fixing post thereof;

said connection part, bent in an angle, having an upper and a lower coupling holes disposed at both ends thereof; said long tubular rod being a tube body of proper length with a control handle disposed at the lower section thereof;

said block having serrated polygonal flange disposed at one inner side thereof, and a slot disposed at the center thereof;

in assembly, said staged groove and said tubular column thereof are led and engaged with said circular outer flange and said fixing post thereof with said large and small ring washers adapted thereto respectively; said flexible locating means is inserted to one of said locating slots thereof for proper location thereof; said serrated polygonal head thereof is led and abutted against said staged through hole thereof; said block is joined to said serrated polygonal head via said serrated polygonal flange thereof securely engaging therewith, and said fixing bolt is screwed up to said internal threads of said fixing post thereof so as to pivotally secure said rotary member and said fixed member thereof;

whereby, via said rotary member, said connector head can be adjusted stepwise into a proper angle for use; when said connector head is pushed up or down, said rotary member screw joined to said connector head thereof will pivotally rotate therewith and then relocated into position via said flexible locating means properly engaged with one of said locating slots thereof so as to easily and quickly adjust said connector head thereof into a proper angle for use.

2. The long-handled spray gun with a rotary head as claimed in claim 1 wherein said serrated fixing head projecting at the front of said fixing post thereof is polygonal in shape.

3. The long-handled spray gun with a rotary head as claimed in claim 1 wherein said serrated flange of said block thereof is polygonal in shape matching to said serrated polygonal fixing head of said fixing post thereof.

4. The long-handled spray gun with a rotary head as claimed in claim 1, wherein the serrated polygonal fixing head of said fixing post thereof is securely engaged with the serrated polygonal flange of said block thereof, preventing said fixing bolt screwed up to the inner thread of said fixing post thereof from coming off when said rotary member thereof are pivotally rotated to adjust the angle of said connector head for use.

5. The long-handled spray gun with a rotary head as claimed in claim 2, wherein the serrated polygonal fixing head of said fixing post thereof is securely engaged with the serrated polygonal flange of said block thereof, preventing said fixing bolt screwed up to the inner thread of said fixing post thereof from coming off when said rotary member thereof are pivotally rotated to adjust the angle of said connector head for use.

6. The long-handled spray gun with a rotary head as claimed in claim 3, wherein the serrated polygonal fixing head of said fixing post thereof is securely engaged with the serrated polygonal flange of said block thereof, preventing said fixing bolt screwed up to the inner thread of said fixing post thereof from coming off when said rotary member thereof are pivotally rotated to adjust the angle of said connector head for use.

* * * * *